US011835979B2

(12) United States Patent
Huang

(10) Patent No.: US 11,835,979 B2
(45) Date of Patent: Dec. 5, 2023

(54) VOLTAGE REGULATOR DEVICE

(71) Applicant: REALTEK SEMICONDUCTOR CORP., Hsinchu (TW)

(72) Inventor: Han-Hsiang Huang, Hsinchu (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 17/871,378

(22) Filed: Jul. 22, 2022

(65) Prior Publication Data

US 2023/0035977 A1 Feb. 2, 2023

(30) Foreign Application Priority Data

Jul. 28, 2021 (TW) ..... 110127784

(51) Int. Cl.
*G05F 1/46* (2006.01)
*G05F 1/59* (2006.01)

(52) U.S. Cl.
CPC ..... *G05F 1/468* (2013.01); *G05F 1/59* (2013.01)

(58) Field of Classification Search
CPC ..... G05F 1/468; G05F 1/59
See application file for complete search history.

(56) References Cited

U.S. PATENT DOCUMENTS

2007/0139030 A1* 6/2007 Lee ..... G05F 3/30 323/315
2009/0302823 A1* 12/2009 Chao ..... G05F 3/30 323/313
2013/0200872 A1* 8/2013 Friend ..... G05F 1/10 323/284
2014/0055112 A1* 2/2014 Pigott ..... G05F 1/575 323/282
2015/0177754 A1* 6/2015 Mengad ..... G05F 1/575 323/280
2023/0163769 A1* 5/2023 Kumar ..... H03L 7/1072 327/156

* cited by examiner

*Primary Examiner* — Jue Zhang
*Assistant Examiner* — Lakaisha Jackson
(74) *Attorney, Agent, or Firm* — Birch, Stewart, Kolasch & Birch, LLP

(57) ABSTRACT

A device includes a first impedance; a reference current generation circuit configured to generate a reference current according to a first potential difference, a reference voltage, and a first impedance value of the first impedance; a current mirror circuit configured to output an output current having a first ratio to the reference current according to the reference current; a second impedance configured to generate an output voltage according to a second impedance value of the second impedance, a voltage of a first node which is the same as the first potential difference, and the output current; and a negative feedback circuit configured to generate a feedback voltage according to the voltage of the first node, and adjust the output voltage according to the feedback voltage. There is a second ratio that is inversely proportional to the first ratio between the second impedance value and the first impedance value.

20 Claims, 1 Drawing Sheet

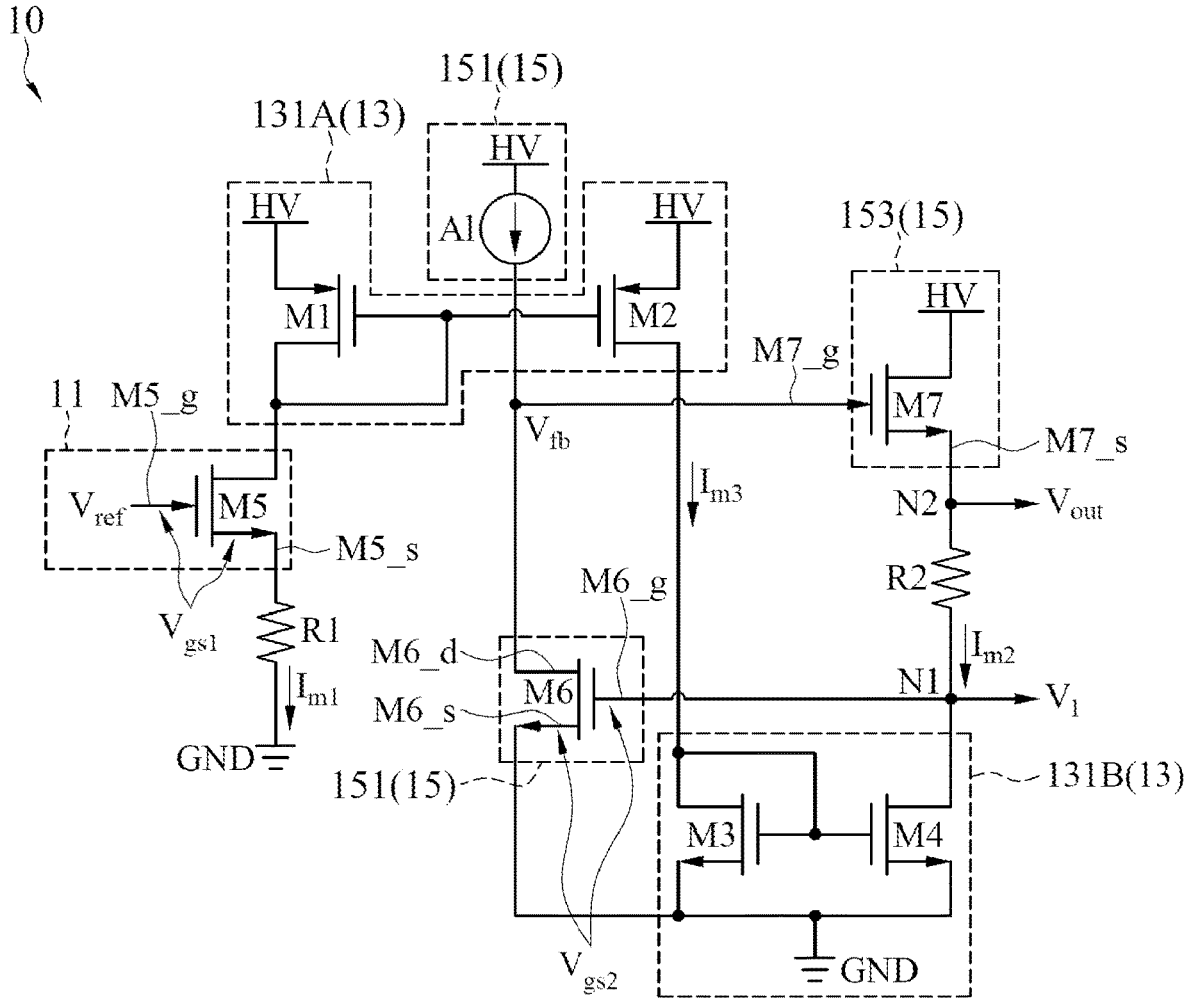
10
151(15)
131A(13)
HV
HV
HV
A1
153(15)
HV
M1
M2
M7_g
11
M5_g
M7
M7_s
$V_{fb}$
$V_{ref}$
M5
$I_{m3}$
N2
$V_{out}$
M5_s
R2
M6_g
$V_{gs1}$
R1
M6_d
$I_{m2}$
$I_{m1}$
M6
N1
$V_1$
M6_s
GND
151(15)
131B(13)
M3
M4
$V_{gs2}$
GND

VOLTAGE REGULATOR DEVICE

CROSS-REFERENCE TO RELATED APPLICATION

This non-provisional application claims priority under 35 U.S.C. § 119(a) to Patent Application No. 110127784 filed in Taiwan, R.O.C. on Jul. 28, 2021, the entire contents of which are hereby incorporated by reference.

BACKGROUND

Technical Field

The present invention relates to a voltage generation technology, and in particular, to a voltage regulator device.

Related Art

Generally, a voltage regulator that keeps an output voltage from being affected by a load includes an operational amplifier (OPA). The voltage regulator uses the OPA to lock a voltage, so that an output voltage does not change with a load. However, the OPA is a complex circuit including a plurality of sub-circuits with different functions. Therefore, the OPA may occupy a larger area of a voltage regulator or a chip. Secondly, the OPA is a complex circuit. Compared with a simple circuit, the OPA needs to perform more component variability compensation, which limits an operational bandwidth of the OPA during voltage regulation (for example, the OPA cannot operate in a higher-speed bandwidth).

In addition, a voltage follower is another circuit for generating a voltage, and has a simple structure. However, the voltage generated by the voltage follower changes under impact of a temperature. Secondly, because the voltage follower is an open loop, the voltage also varies with a load.

SUMMARY

In summary, the present invention provides a voltage regulator device. According to some embodiments, the voltage regulator device can prevent an output voltage thereof from being affected by load and a temperature without performing redundant component variability compensation. According to some embodiments, the voltage regulator device can reduce an area occupied by itself on a device or a chip.

According to some embodiments, the voltage regulator device includes a first impedance, a reference current generation circuit, a current mirror circuit, a second impedance, and a negative feedback circuit. The first impedance has a first impedance value. The reference current generation circuit is coupled to the first impedance and a reference voltage. The reference current generation circuit has a first potential difference. The reference current generation circuit is configured to generate a reference current according to the reference voltage, the first potential difference, and the first impedance value. The current mirror circuit is coupled to the reference current generation circuit and a first node. The current mirror circuit is configured to output an output current to the first node according to the reference current. There is a first ratio between the output current and the reference current. The second impedance is coupled between the first node and a second node. The second impedance has a second impedance value. The second impedance is configured to generate an output voltage at the second node according to a voltage of the first node, the output current, and the second impedance value. There is a second ratio between the second impedance value and the first impedance value. The second ratio and the first ratio are inversely proportional to each other. The negative feedback circuit is coupled to the first node and the second node. The negative feedback circuit is configured to generate a feedback voltage according to the voltage of the first node, and adjust the output voltage according to the feedback voltage. The voltage of the first node is substantially the same as the first potential difference, so that the output voltage conforms to the reference voltage.

In summary, according to some embodiments, the voltage regulator device has a simple structure, so that unnecessary component variability compensation is not required, and an operating bandwidth is not limited (for example, the voltage regulator device can operate in a high-speed bandwidth). According to some embodiments, the first ratio (the ratio between the output current and the reference current) and the second ratio (the ratio between the second impedance value and the first impedance value) are inversely proportional to each other, so that the output voltage is not affected by the temperature. According to some embodiments, the output voltage is adjusted by the negative feedback circuit, to prevent the output voltage from being affected by the load.

BRIEF DESCRIPTION OF THE DRAWINGS

FIG. 1 is a block diagram of a voltage regulator device according to some embodiments of the present invention.

DETAILED DESCRIPTION

Terms, such as "first" and "second", are used in this specification to distinguish referred components, not to order or limit differences of the referred components, and are not used to limit a scope of the present invention. In addition, terms, such as "couple", are used mean that two or more components are directly in physical or electrical contact with each other, or are indirectly in physical or electrical contact with each other. For example, if the specification describes that a first device is coupled to a second device, it means that the first device may be directly and electrically connected to the second device, or indirectly and electrically connected to the second device through another device or connecting means.

FIG. 1 is a block diagram of a voltage regulator device 10 according to some embodiments of the present invention. The voltage regulator device 10 includes a first impedance R1, a reference current generation circuit 11, a current mirror circuit 13, a second impedance R2, and a negative feedback circuit 15. The reference current generation circuit 11 is coupled to the first impedance R1 and a reference voltage $V_{ref}$ The current mirror circuit 13 is coupled to the reference current generation circuit 11 and a first node N1. The second impedance R2 is coupled between the first node N1 and a second node N2. The negative feedback circuit 15 is coupled to the first node N1 and the second node N2. In some embodiments, the first impedance R1, the current mirror circuit 13, and the negative feedback circuit 15 are further coupled to a ground terminal GND.

The reference voltage $V_{ref}$ may be a temperature coefficient band gap reference voltage generated by a band gap reference voltage generation circuit (not shown). In other words, the reference voltage $V_{ref}$ may be a voltage that is irrelevant to a temperature coefficient or a voltage that does not vary with a temperature.

The first impedance R1 has a first impedance value. The first impedance R1 may be formed by passive components such as a resistor, a capacitor, and an inductor. The first impedance R1 is coupled between the ground terminal GND and the reference current generation circuit 11. In some embodiments, as shown in FIG. 1, the first impedance R1 is a resistance, and the first impedance value is a resistance value. Although in FIG. 1, the first impedance R1 is represented by only one resistance symbol, the present invention is not limited thereto, and the first impedance R1 may include, according to actual design requirements, a plurality of resistances connected in series and/or in parallel. In addition, the resistance can be implemented by a metal oxide semiconductor transistor, or a well region of an ion implantation stroke.

The reference current generation circuit 11 has a first potential difference $V_{gs1}$. The reference current generation circuit 11 is configured to generate a reference current $I_{m1}$ according to the reference voltage $V_{ref}$, the first potential difference $V_{gs1}$, and the first impedance value. In some embodiments, as shown in Equation 1, the reference current $I_{m2}$ is obtained by the reference current generation circuit 11 by dividing the reference voltage $V_{ref}$ minus the first potential difference $V_{gs1}$ by the first impedance value.

$$I_{m1} = \frac{(V_{ref} - V_{gs1})}{r1} \quad \text{(Equation 1)}$$

r1 is the first impedance value.

The current mirror circuit 13 is configured to output an output current $I_{m2}$ to the first node N1 (described below) according to the reference current $I_{m1}$, where there is a first ratio between the output current $I_{m2}$ and the reference current $I_{m1}$ (as shown in Equation 2).

$$I_{m2}=I_{m1}*k1 \quad \text{(Equation 2)}$$

k1 is the first ratio.

The second impedance R2 has a second impedance value. The second impedance R2 may be formed by passive components such as a resistor, a capacitor, and an inductor. In some embodiments, as shown in FIG. 1, the second impedance R2 is a resistance, and the second impedance value is a resistance value. Although in FIG. 1, the second impedance R2 is represented by only one resistance symbol, the present invention is not limited thereto, and the second impedance R2 may include, according to actual design requirements, a plurality of resistance connected in series and/or in parallel. In addition, the resistance can be implemented by a metal oxide semiconductor transistor, or a well region of an ion implantation stroke. The second impedance R2 is configured to generate an output voltage $V_{out}$ at the second node N2 according to a voltage $V_1$ of the first node N1, the output current $I_{m2}$, and the second impedance value. As shown in Equation 3 and Equation 4, there is a second ratio between the second impedance value and the first impedance value, and the second ratio and the first ratio are inversely proportional to each other.

$$r2 = r1 * k2 \quad \text{(Equation 3)}$$

$$k2 = \frac{1}{k1} \quad \text{(Equation 4)}$$

r1 is the first impedance value, r2 is the second impedance value, k1 is the first ratio, and k2 is the second ratio.

In some embodiments, the second ratio is determined according to a temperature coefficient of the first impedance R1 and a temperature coefficient of the second impedance R2. An example in which both the first impedance R1 and the second impedance R2 are resistances is used for description. Because the first impedance R1 and the second impedance R2 are made of different materials, the first impedance R1 and the second impedance R2 have different resistance temperature coefficients. Therefore, at the same temperature, the first impedance value is different from the second impedance value. The resistance temperature coefficient is a positive temperature coefficient or a negative temperature coefficient depending on a nature of the material (for example, if the material is a conductor, the temperature coefficient of the resistance is a positive temperature coefficient, and if the material is a semiconductor or an insulator, the temperature coefficient of the resistance is a negative temperature coefficient). Therefore, in a condition that the first impedance R1 and the second impedance R2 are made of the same material, the first impedance value is still different from the second impedance value when the first impedance R1 and the second impedance R2 are at different temperatures. In other words, because the first impedance R1 and the second impedance R2 vary with a temperature, the second ratio varies with the temperature. In some embodiments, the second ratio is directly proportional to the second impedance value, and the second ratio is inversely proportional to the first impedance value, but the present invention is not limited thereto. The second ratio may be directly proportional to the first impedance value, and the second ratio may be inversely proportional to the second impedance value.

In some embodiments, as shown in Equation 5, the output voltage $V_{out}$ is obtained by the second impedance R2 by multiplying the output current $I_{m2}$ by a second impedance value and then adding the voltage $V_1$ of the first node N1.

$$V_{out}=V_1+I_{m2}*r2 \quad \text{(Equation 5)}$$

Equation 6 may be obtained by integrating Equation 1 to Equation 5. It can be seen that the output voltage VOU, is irrelevant to the first impedance value and the second impedance value, that is, the output voltage $V_{out}$ does not vary with a temperature.

$$V_{out}=V_{ref}+V_1-V_{gs1} \quad \text{(Equation 6)}$$

A negative feedback circuit 15 is configured to generate a feedback voltage $V_{th}$ according to the voltage $V_1$ of the first node N1, and adjust the output voltage $V_{out}$ according to the feedback voltage $V_{fb}$. For example, when a load falls, the output voltage $V_{out}$ rises. In this case, the negative feedback circuit 15 lowers the output voltage $V_{out}$ according to the voltage $V_1$ of the first node N1 and the feedback voltage $V_{out}$ to stabilize the output voltage $V_{out}$ at a voltage level. When the load rises, the output voltage $V_{out}$ falls. In this case, the negative feedback circuit 15 raises the output voltage $V_{out}$ according to the voltage $V_1$ of the first node N1 and the feedback voltage $V_{fb}$ to stabilize the output voltage $V_{out}$ at the voltage level. In other words, the output voltage $V_{out}$ is prevented by the negative feedback circuit 15 from varying with the load.

The voltage $V_1$ of the first node N1 is substantially the same as the first potential difference $V_{gs1}$, so that the output voltage $V_{out}$ conforms to the reference voltage $V_{out}$. Specifically, the output voltage $V_{out}$ may vary with the temperature because the voltage $V_1$ of the first node N1 may vary with the temperature. Thus, the output voltage $V_{out}$ conforms to the reference voltage $V_{ref}$ and is irrelevant to the temperature when the voltage $V_1$ of the first node N1 is substantially the same as the first potential difference $V_{gs1}$ For example, the voltage $V_1$ of the first node N1 is a second potential difference $V_{gs2}$ of a sixth transistor M6 of the negative feedback circuit 15 (for example, the sixth transistor M6 is a metal oxide semiconductor (MOS) transistor, and the second potential difference $V_{gs2}$ is a potential difference between a gate and a source). Because the sixth transistor M6 has a negative temperature coefficient, the second potential difference $V_{gs2}$ changes under impact of a temperature (that is, when the temperature becomes higher, the second potential difference $V_{gs2}$ becomes smaller; and when the temperature becomes lower, the second potential difference $V_{gs2}$ becomes larger). Therefore, the output voltage $V_{out}$ is irrelevant to the temperature when the voltage $V_1$ (for example, the second potential difference $V_{gs2}$) of the first node N1 is substantially the same as the first potential difference $V_{gs1}$.

As shown in FIG. 1, in some embodiments, the current mirror circuit 13 and the negative feedback circuit 15 are further coupled to a working voltage terminal HV for operation of the current mirror circuit 13 and the negative feedback circuit 15. The voltage of the working voltage terminal HV is greater than an output voltage $V_{out}$ Specifically, because the output voltage $V_{out}$ conforms to the reference voltage $V_{ref}$, a value of the reference voltage $V_{ref}$ is smaller than a value of the voltage of the working voltage terminal HV. Therefore, the voltage of the working voltage terminal HV is provided to the voltage regulator device 10, so that the voltage regulator device 10 lowers the voltage from the working voltage terminal HV to output a relatively small output voltage $V_{out}$.

As shown in FIG. 1, in some embodiments, the current mirror circuit 13 includes a first current mirror circuit 131A and a second current mirror circuit 131B. Although FIG. 1 shows the two current mirror circuits 131A and 131B, the present invention is not limited thereto. The current mirror circuit 13 may include one or more than the two current mirror circuits. The first current mirror circuit 131A is coupled to the reference current generation circuit 11, and the second current mirror circuit 131B is coupled to the first current mirror circuit 131A and the first node N1. The first current mirror circuit 131A is configured to output a mirror current $I_{m3}$ according to the reference current $I_{m1}$. As shown in Equation 7, there is a third ratio between the mirror current $I_{m3}$ and the reference current $I_{m1}$. For example, the third ratio is directly proportional to the reference current $I_{m1}$, and the third ratio is inversely proportional to the mirror current $I_{m3}$, but the present invention is not limited thereto. The third ratio may be directly proportional to the reference current $I_{m1}$, and the third ratio is inversely proportional to the mirror current $I_{m3}$. The third ratio may be constant or configurable. For example, the first current mirror circuit 131A is an adjustable current mirror, so that the third ratio can be adjusted. The second current mirror circuit 131B is configured to output the output current $I_{m2}$ to the first node N1 according to the mirror current $I_{m3}$. As shown in Equation 8, there is a fourth ratio between the output current $I_{m2}$ and the mirror current $I_{m3}$. For example, the fourth ratio is directly proportional to the mirror current $I_{m3}$, and the fourth ratio is inversely proportional to the output current $I_{m2}$, but the present invention is not limited thereto. The fourth ratio may be directly proportional to the mirror current $I_{m3}$, and the fourth ratio is inversely proportional to the output current $I_{m2}$. The fourth ratio may be constant or configurable. For example, the second current mirror circuit 131B is an adjustable current mirror, so the fourth ratio can be adjusted. The third ratio and the fourth ratio form the first ratio. For example, as shown in Equation 9, a reciprocal of the third ratio multiplied by the fourth ratio is the first ratio. In other words, the first ratio, the third ratio, and the fourth ratio are inversely proportional to each other.

$$\frac{I_{m1}}{I_{m3}} = k_3 \quad \text{(Equation 7)}$$

$$\frac{I_{m3}}{I_{m2}} = k_4 \quad \text{(Equation 8)}$$

$$k_3 * k_4 = \frac{1}{k_1} \quad \text{(Equation 9)}$$

$k_3$ is the third ratio, $k_4$ is the fourth ratio, and $k_1$ is the first ratio.

As shown in FIG. 1, in some embodiments, the first current mirror circuit 131A includes a first transistor M1 and a second transistor M2. The second current mirror circuit 131B includes a third transistor M3 and a fourth transistor M4. The first transistor M1 and the second transistor M2 may be P-type MOS transistors or P-type bipolar transistors. The third transistor M3 and the fourth transistor M4 may be N-type MOS transistors or N-type bipolar transistors. Descriptions are made herein by using an example in which the first transistor M1 and the second transistor M2 are P-type MOS transistors, and the third transistor M3 and the fourth transistor M4 are N-type MOS transistors.

The first transistor M1 is coupled between the working voltage terminal HV and the reference current generation circuit 11 (specifically, a source of the first transistor M1 is coupled to the working voltage terminal HV, and a drain of the first transistor M1 is coupled to the reference current generation circuit 11)., The reference current $I_{m1}$ flows through the first transistor M1. The second transistor M2 is coupled between the working voltage terminal HV and the second current mirror circuit 131B (specifically, the source of the second transistor M2 is coupled to the working voltage terminal HV, and a drain of the second transistor M2 is coupled to the second current mirror circuit 131B). Gates of the first transistor M1 and the second transistor M2, and the drain of the first transistor M1 are coupled together. The first current mirror circuit 131A generates the mirror current $I_{m3}$ at the drain of the second transistor M2 according to the reference current $I_{m1}$ flowing through the first transistor M1, that is, the mirror current $I_{m3}$ flows through the second transistor M2. In some embodiments, as shown in Equation 10, the third ratio is determined according to size ratios of the first transistor M1 and the second transistor M2 (for example, the potential difference from the drain to the gate of the first transistor M1 is equal to or close to the potential difference from the drain to the gate of the second transistor M2, so that a channel length modulation effect produced by the first transistor M1 and the second transistor M2 for the reference current $I_{m1}$ and the mirror current $I_{m3}$ can be ignored).

$$\frac{I_{m1}}{I_{m3}} = \frac{\left(\frac{W}{L}\right)_1}{\left(\frac{W}{L}\right)_3} = k_3 \quad \text{(Equation 10)}$$

$$\left(\frac{W}{L}\right)_1$$

is the size ratio of the first transistor M1, where W is a width of the gate of the first transistor M1, and L is a length of the gate of the first transistor M1, and $$\left(\frac{W}{L}\right)_3$$

is the size ratio of the second transistor M2, where W is the width of the gate of the second transistor M2, L is the length of the gate of the second transistor M2, and $k_3$ is the third ratio.

In some embodiments, there are a plurality of first transistors M1 that are connected in parallel to each other and/or a plurality of second transistors M2 that are connected in parallel to each other. The third ratio is determined according to a quantity of the first transistors M1 and a quantity of the second transistors M2. For example, the quantity of the first transistors M1 that are connected in parallel to each other and the quantity of the second transistors M2 that are connected in parallel to each other affect a parameter of channel length modulation, and further affect the value of the mirror current $I_{m3}$.

The third transistor M3 is coupled between a ground terminal GND and the first current mirror circuit 131A (specifically, the source of the third transistor M3 is coupled to the ground terminal GND, and a drain of the third transistor M3 is coupled to the first current mirror circuit 131A), The mirror current $I_{m3}$ flows through the third transistor M3. The fourth transistor M4 is coupled between the ground terminal GND and the first node N1 (specifically, the source of the fourth transistor M4 is coupled to the ground terminal GND, and a drain of the fourth transistor M4 is coupled to the first node N1). The gates of the third transistor M3 and the fourth transistor M4, and the drain of the third transistor M3 are coupled together. The second current mirror circuit 131B generates the output current $I_{m2}$ at the drain of the fourth transistor M4 according to the mirror current $I_{m3}$ flowing through the third transistor M3, that is, the output current $I_{m2}$ flows through the fourth transistor M4. In some embodiments, as shown in Equation 11, the fourth ratio is determined according to size ratios of the third transistor M3 and the fourth transistor M4 (for example, the potential difference from the drain to a gate of the third transistor M3 and the potential difference from the drain to the gate of the fourth transistor M4 are equal to or close to each other, so that the channel length modulation effects produced by the third transistor M3 and the fourth transistor M4 for the mirror current $I_{m3}$ and the output current $I_{m2}$ can be ignored).

$$\frac{I_{m3}}{I_{m2}} = \frac{\left(\frac{W}{L}\right)_3}{\left(\frac{W}{L}\right)_2} = k_4 \quad \text{(Equation 11)}$$

$$\left(\frac{W}{L}\right)_3$$

is the size ratio of the third transistor M3, where W is the width of the gate of the third transistor M3, and L is the length of the gate of the third transistor M3, and $$\left(\frac{W}{L}\right)_2$$

is the size ratio of the fourth transistor M4, where W is the width of the gate of the fourth transistor M4, L is the length of the gate of the fourth transistor M4, and $k_4$ is the fourth ratio.

In some embodiments, there are a plurality of third transistors M3 that are connected in parallel to each other and/or a plurality of fourth transistors M4 that are connected in parallel to each other. The fourth ratio is determined according to a quantity of the third transistors M3 and a quantity of the fourth transistors M4. For example, the quantity of the third transistor M3 that are connected in parallel to each other and the quantity of the fourth transistors M4 that are connected in parallel to each other affect a parameter of channel length modulation, and further affect the value of the output current $I_{m2}$.

It is worth noting that the first current mirror circuit 131A may also be implemented by an N-type MOS transistor or an N-type bipolar transistor, and the second current mirror circuit 131B may also be implemented by a P-type MOS transistor or a P-type bipolar transistor. In addition, in the foregoing case, how to appropriately adjust the structure of the current mirror circuit 13 (or the first current mirror circuit 131A and the second current mirror circuit 131B) can be derived from the disclosure of the present invention.

As shown in FIG. 1, in some embodiments, the reference current generation circuit 11 includes a fifth transistor M5. The fifth transistor M5 includes a first control terminal M5_g and a first terminal M5_s. The fifth transistor M5 is coupled between the first impedance R1 and the current mirror circuit 13 (specifically, the fifth transistor M5 is coupled between the first impedance R1 and the first current mirror circuit 131A). The first control terminal M5_g is coupled to the reference voltage $V_{ref}$, and the first terminal M5_s is coupled to the first impedance R1. There is a first potential difference $V_{ref}$ between the first control terminal M5_g and the first terminal M5_s. The fifth transistor M5 generates the reference current $I_{m1}$ according to the reference voltage $V_{ref}$, the first potential difference $V_{gs1}$ and the first impedance value. For example, the fifth transistor M5 generates the reference current $I_{m1}$ in a manner of Equation 1.

Descriptions are made by using an example in which the fifth transistor M5 is an N-type MOS transistor. The first control terminal M5_g is a gate of the fifth transistor M5, the first terminal MS_s is a source of the fifth transistor M5, and a drain of the fifth transistor M5 is coupled to the current mirror circuit 13 (specifically, as shown in FIG. 1, using an example in which the first transistor M1 is a P-type MOS transistor, the drain of the fifth transistor M5 is coupled to the drain of the first transistor M1). In addition, because a potential difference from the drain to the source of the fifth transistor M5 is close to zero, the fifth transistor M5 generates the same (substantially the same) reference current $I_{m1}$ at the drain and the source. The first potential difference $V_{gs1}$ is a gate-source voltage of the fifth transistor M5 (that is, the potential difference from the gate to the source). Because the N-type MOS transistor has a negative temperature coefficient, the gate-source voltage (that is, the first potential difference $V_{gs1}$) changes under impact of a temperature. For example, when the temperature becomes higher, the first potential difference $V_{gs1}$ becomes smaller, and when the temperature becomes lower, the first potential difference $V_{gs1}$ becomes larger.

In some embodiments, the fifth transistor M5 is an N-type MOS transistor or an N-type bipolar transistor, but the present invention is not limited thereto. The fifth transistor M5 may be a P-type MOS transistor or a P-type bipolar transistor. In addition, in the foregoing case, how to appropriately adjust the structure of the reference current generation circuit 11 can be derived from the disclosure of the present invention.

As shown in FIG. 1, in some embodiments, the negative feedback circuit 15 includes a feedback circuit 151 and a voltage follower circuit 153. The feedback circuit 151 is coupled to the first node N1. The voltage follower circuit 153 is coupled to the second node N2 and the feedback circuit 151. The feedback circuit 151 is configured to generate the feedback voltage $V_{fb}$ according to the voltage $V_1$ of the first node N1. When the load falls, the output voltage $V_{out}$ rises, the voltage $V_1$ of the first node N1 rises, and the feedback voltage $V_{fb}$ falls. When the load rises, the output voltage $V_{out}$ falls, the voltage $V_1$ of the first node N1 falls, and the feedback voltage $V_{fb}$ rises. The voltage follower circuit 153 is configured to raise the output voltage $V_{out}$ when the feedback voltage V rises, and to lower the output voltage $V_{out}$ when the feedback voltage $V_{fb}$ falls.

In some embodiments, the feedback circuit 151 includes a sixth transistor M6. The sixth transistor M6 includes a second control terminal M6_g and a second terminal M6_s. The sixth transistor M6 is coupled among the ground terminal GND, the first node N1, and the voltage follower circuit 153. The second control terminal M6_g is coupled to the first node N1, and the second terminal M6_s is coupled to the ground terminal GND. There is the second potential difference $V_{gs2}$ forming the voltage $V_1$ of the first node N1 between the second control terminal M6_g and the second terminal M6_s. In other words, the potential difference between the second control terminal M6_g and the second terminal M6_s (that is, the second potential difference $V_{gs2}$) is the voltage $V_1$ of the first node N1. The sixth transistor M6 is configured to generate the feedback voltage $V_{fb}$ according to the voltage $V_1$ of the first node N1. In some embodiments, the sixth transistor M6 further includes a feedback terminal M6_d. The feedback terminal M6_d is coupled to a current source A1 and the voltage follower circuit 153. A terminal of the current source A1, other than terminals coupled to the feedback terminal M6_d and the voltage follower circuit 153, is coupled to the working voltage terminal HV. In other words, the current source A1 is coupled to the working voltage terminal HV, the voltage follower circuit 153, and the feedback terminal M6_d.

Descriptions are made by using an example in which the sixth transistor M6 is an N-type MOS transistor. The second control terminal M6_g is a gate of the sixth transistor M6, the second terminal M6_s is a source of the sixth transistor M6, and the feedback terminal M6_d is a drain of the sixth transistor M6. The sixth transistor M6 generates the feedback voltage VA at the feedback terminal M6_d according to the voltage $V_1$ of the first node N1 and a current of the current source A1. Specifically, because the feedback terminal M6_d is coupled to the current source A1, the feedback terminal M6_d has a constant current. Therefore, when the load falls, the output voltage $V_{out}$ rises, and the voltage $V_1$ of the first node N1 rises (as shown in Equation 5). In this case, the sixth transistor M6 lowers the feedback voltage $V_{fb}$ generated at the feedback terminal M6_d. When the load rises, the output voltage $V_{fb}$ falls, and the voltage $V_1$ of the first node N1 falls (as shown in Equation 5). In this case, the sixth transistor M6 raises the feedback voltage $V_{fb}$ generated at the feedback terminal M6_d. The second potential difference $V_{gs2}$ is a gate-source voltage of the sixth transistor M6 (that is, the potential difference from the gate to the source). Because the second potential difference $V_{gs2}$ is affected by a temperature, the voltage $V_1$ of the first node N1 and the output voltage $V_{out}$ are further affected by the temperature. Therefore, to prevent the output voltage $V_{out}$ from being affected by the temperature, the first potential difference $V_{gs1}$ between the first control terminal M5_g and the first terminal M5_s is made substantially the same as the second potential difference $V_{gs2}$. The fifth transistor M5 having the same specification as the sixth transistor M6, so that the output voltage $V_{out}$ is irrelevant to the temperature. For example, referring to Equation 6, the voltage $V_1$ of the first node N1 is the second potential difference $V_{gs2}$, and the second potential difference $V_{gs2}$ is substantially the same as the first potential difference $V_{gs1}$. Therefore, the output voltage $V_{out}$ conforms to (for example, equals) the reference voltage $V_{ref}$, and the output voltage $V_{out}$ is irrelevant to the temperature.

In some embodiments, the sixth transistor M6 is an N-type MOS transistor or an N-type bipolar transistor, but the invention is not limited thereto. The sixth transistor M6 may be a P-type MOS transistor or a P-type bipolar transistor. In addition, in the foregoing case, how to appropriately adjust the structure of the feedback circuit 151 can be derived from the disclosure of the present invention.

In some embodiments, the voltage follower circuit 153 is the source follower circuit, including a seventh transistor M7. The seventh transistor M7 is an N-type MOS transistor. In some embodiments, the voltage follower circuit 153 is an emitter follower circuit. In this case, the seventh transistor M7 is an N-type bipolar transistor. Descriptions are made by using an example in which the voltage follower circuit 153 is a source follower circuit, and the seventh transistor M7 is an N-type MOS transistor. The seventh transistor M7 includes a third control terminal M7_g and a third terminal M7_s. The seventh transistor M7 is coupled between the working voltage terminal HV and the second node N2 (specifically, a drain of the seventh transistor M7 is coupled to the working voltage terminal HV, and the third terminal M7_s is coupled to the second node N2). The third control terminal M7_g is coupled to the feedback circuit 151 (specifically, the third control terminal M7_g is coupled to the current source A1 and the feedback terminal M6_d of the sixth transistor M6). The third control terminal M7_g is a gate of the seventh transistor M7, and the third terminal M7_s is a source of the seventh transistor M7. A ratio between an input voltage of a source follower circuit (a voltage from the third control terminal M7_g, that is, the feedback voltage $V_{fb}$) and an output voltage $V_{out}$, of the source follower circuit (a voltage from the third terminal M7_s, that is, the voltage of the second node N2) is approximately one (in other words, an amplification factor of the source follower circuit for amplifying the input voltage to the output voltage $V_{out}$ is one or approximately one), and the input voltage and the output voltage are in phase with each other. Therefore, when the feedback voltage $V_{fb}$ rises (that is, the load is rising at this time), the seventh transistor M7 raises the output voltage $V_{out}$ through the third terminal M7_s according to the amplification factor (for example, raises the output voltage $V_{out}$ to or close to the feedback voltage VA) to stabilize the output voltage $V_{out}$ at a voltage level. When the feedback voltage $V_{fb}$ falls (that is, the load is falling at this time), the seventh transistor M7 lowers the output voltage $V_{out}$ through the third terminal M7_s according to the amplification factor (for example, lowers the output voltage $V_{out}$ to or close to the feedback voltage $V_{fb}$) to stabilize the output voltage $V_{out}$ at the voltage level. In this way, the output voltage $V_{out}$ is not affected by the load.

In some embodiments, when the voltage follower circuit 153 is a source follower circuit, the seventh transistor M7 may be a P-type MOS transistor. In addition, in the foregoing case, how to appropriately adjust a structure of the voltage follower circuit 153 can be derived from the disclosure of the present invention. In some embodiments, when the voltage follower circuit 153 is an emitter follower circuit, the seventh transistor M7 may be a P-type bipolar transistor. In addition, in the foregoing case, how to appropriately adjust the structure of the voltage follower circuit 153 can be derived from the disclosure of the present invention.

It can be seen from the above that the voltage regulator device 10 can generate the output voltage $V_{out}$ in an integrated circuit with a simple circuit structure, and the output voltage $V_{out}$ is irrelevant to the temperature and the load. Operation of the voltage regulator device 10 does not require additional output pins and external components, and therefore, has an advantage of saving a circuit area. In addition, because no additional component variability compensation is required, an operating bandwidth is not limited.

In summary, according to some embodiments, the voltage regulator device has a simple structure, so that unnecessary component variability compensation is not required, and an operating bandwidth is not limited (for example, the voltage regulator device can operate in a high-speed bandwidth). According to some embodiments, the first ratio (the ratio between the output current and the reference current) and the second ratio (the ratio between the second impedance value and the first impedance value) are inversely proportional to each other, so that the output voltage is not affected by the temperature. According to some embodiments, the output voltage is adjusted by the negative feedback circuit, to prevent the output voltage from being affected by the load.

What is claimed is:

1. A device comprising:

a first impedance having a first impedance value;

a reference current generation circuit coupled to the first impedance and a reference voltage, having a first potential difference, and configured to generate a reference current according to the reference voltage, the first potential difference, and the first impedance value;

a current mirror circuit coupled to the reference current generation circuit and a first node and configured to output an output current to the first node according to the reference current, wherein there is a first ratio between the output current and the reference current;

a second impedance coupled between the first node and a second node, having a second impedance value, and configured to generate an output voltage at the second node according to a voltage of the first node, the output current, and the second impedance value, wherein there is a second ratio between the second impedance value and the first impedance value, and the second ratio and the first ratio are inversely proportional to each other; and a negative feedback circuit coupled to the first node and the second node and configured to generate a feedback voltage according to the voltage of the first node and adjust the output voltage according to the feedback voltage, wherein the voltage of the first node is substantially the same as the first potential difference, so that the output voltage conforms to the reference voltage.

2. The device according to claim 1, wherein the second ratio is determined according to a temperature coefficient of the first impedance and a temperature coefficient of the second impedance.

3. The device according to claim 1, wherein the current mirror circuit comprises:

a first current mirror circuit, coupled to the reference current generation circuit, and configured to output a mirror current according to the reference current, wherein there is a third ratio between the mirror current and the reference current; and a second current mirror circuit, coupled to the first current mirror circuit and the first node, and configured to output the output current to the first node according to the mirror current, wherein there is a fourth ratio between the output current and the mirror current, and the third ratio and the fourth ratio form the first ratio.

4. The device according to claim 3, wherein the first current mirror circuit comprises a first transistor and a second transistor, wherein the reference current flows through the first transistor, and the mirror current flows through the second transistor.

5. The device according to claim 4, wherein there are a plurality of first transistors that are connected in parallel to each other or a plurality of second transistors that are connected in parallel to each other, and the third ratio is determined according to a quantity of the first transistors and a quantity of the second transistors.

6. The device according to claim 4, wherein the first transistor and the second transistor are respectively P-type metal oxide semiconductor (MOS) transistors.

7. The device according to claim 3, wherein the second current mirror circuit comprises a third transistor and a fourth transistor, wherein the mirror current flows through the third transistor, and the output current flows through the fourth transistor.

8. The device according to claim 7, wherein there are a plurality of third transistors that are connected in parallel to each other or a plurality of fourth transistors that are connected in parallel to each other, and the fourth ratio is determined according to a quantity of the third transistors and a quantity of the fourth transistors.

9. The device according to claim 7, wherein the third transistor and the fourth transistor are respectively N-type MOS transistors.

10. The device according to claim 1, wherein the reference current is obtained by dividing the reference voltage minus the first potential difference by the first impedance value.

11. The device according to claim 1, wherein the output voltage is obtained by multiplying the output current by the second impedance value and then adding the voltage of the first node.

12. The device according to claim 1, wherein the current mirror circuit and the negative feedback circuit are further coupled to a working voltage terminal for operation of the current mirror circuit and the negative feedback circuit, and a voltage of the working voltage terminal is greater than the output voltage.

13. The device according to claim 1, wherein the reference current generation circuit comprises:

a fifth transistor, comprising:

a first control terminal, coupled to the reference voltage; and a first terminal, coupled to the first impedance, wherein there is the first potential difference between the first control terminal and the first terminal, and the fifth transistor generates the reference current according to the reference voltage, the first potential difference, and the first impedance value.

14. The device according to claim 1, wherein the negative feedback circuit comprises:

a feedback circuit, coupled to the first node, and configured to generate the feedback voltage according to the voltage of the first node, wherein the voltage of the first node rises and the feedback voltage falls when the output voltage rises, and the voltage of the first node falls and the feedback voltage rises when the output voltage falls; and a voltage follower circuit, coupled to the second node and the feedback circuit, and configured to raise the output voltage when the feedback voltage rises, and lower the output voltage when the feedback voltage falls.

15. The device according to claim 14, wherein the feedback circuit comprises:

a sixth transistor, comprising:

a second control terminal, coupled to the first node; and a second terminal, wherein there is a second potential difference that forms the voltage of the first node between the second control terminal and the second terminal, and the sixth transistor is configured to generate the feedback voltage according to the voltage of the first node.

16. The device according to claim 15, wherein the sixth transistor further comprises a feedback terminal, and the feedback terminal is coupled to a current source and the voltage follower circuit, wherein the sixth transistor generates the feedback voltage at the feedback terminal according to the voltage of the first node and a current of the current source.

17. The device according to claim 15, wherein the reference current generation circuit comprises a fifth transistor that is the same as the sixth transistor, and the fifth transistor comprises a first control terminal and a first terminal, and there is the first potential difference substantially the same as the second potential difference between the first control terminal and the first terminal.

18. The device according to claim 17, wherein the fifth transistor and the sixth transistor are N-type MOS transistors, the first control terminal and the second control terminal are gates of the fifth transistor and the sixth transistor respectively, and the first terminal and the second terminal are sources of the fifth transistor and the sixth transistor respectively, and the first potential difference and the second potential difference are gate-source voltages of the fifth transistor and the sixth transistor, respectively.

19. The device according to claim 14, wherein the voltage follower circuit is a source follower circuit, comprising a seventh transistor, and the seventh transistor comprises:

a third control terminal, coupled to the feedback circuit; and a third terminal, coupled to the second node, wherein the seventh transistor raises the output voltage through the third terminal when the feedback voltage rises, and the seventh transistor lowers the output voltage through the third terminal when the feedback voltage falls.

20. The device according to claim 19, wherein the seventh transistor is an N-type MOS transistor, and the third control terminal is a gate of the seventh transistor, and the third terminal is a source of the seventh transistor.

* * * * *